US008220214B1

(12) United States Patent
Purdy

(10) Patent No.: US 8,220,214 B1
(45) Date of Patent: Jul. 17, 2012

(54) PREFABRICATED WEIGHT DISTRIBUTION ELEMENT

(76) Inventor: Charles L. Purdy, Desert Hot Springs, CA (US)

( * ) Notice: Subject to any disclaimer, the term of this patent is extended or adjusted under 35 U.S.C. 154(b) by 184 days.

(21) Appl. No.: 12/387,442

(22) Filed: May 2, 2009

(51) Int. Cl.
*E04D 27/42* (2006.01)

(52) U.S. Cl. ..... 52/296; 52/708; 52/223.13; 248/678

(58) Field of Classification Search ..... 52/296, 52/294, 295, 297, 298, 704, 705, 707, 708, 52/169.9, 169.3, 834, 843, 223.4, 223.13; 248/678, 679
See application file for complete search history.

(56) References Cited

U.S. PATENT DOCUMENTS 1,529,895 A * 3/1925 La Chance et al. ..... 52/223.5
2,373,798 A * 4/1945 Williams ..... 248/634
3,190,041 A * 6/1965 Kimball ..... 248/679
3,572,223 A * 3/1971 Vierregger ..... 52/296
3,630,474 A * 12/1971 Minor ..... 52/98
3,653,169 A * 4/1972 Jenner ..... 52/298
4,154,037 A 5/1979 Anderson
4,295,308 A * 10/1981 Korfanta ..... 52/296
5,063,719 A * 11/1991 Matsuo et al. ..... 52/296
5,467,569 A * 11/1995 Chiodo ..... 52/713
5,505,033 A * 4/1996 Matsuo et al. ..... 52/296
5,561,950 A * 10/1996 Collins et al. ..... 52/126.6
5,586,417 A 12/1996 Henderson
5,740,645 A * 4/1998 Raby ..... 52/297
5,746,036 A * 5/1998 Angelette ..... 52/295
5,749,189 A * 5/1998 Oberg ..... 52/298
5,826,387 A * 10/1998 Henderson et al. ..... 52/295
5,878,540 A * 3/1999 Morstein ..... 52/296
5,953,874 A * 9/1999 Hoffman et al. ..... 52/299
5,966,882 A * 10/1999 Naito ..... 52/295
6,167,673 B1 * 1/2001 Fournier ..... 52/848
6,254,314 B1 * 7/2001 Park et al. ..... 405/255
6,453,636 B1 9/2002 Ritz
6,702,522 B2 * 3/2004 Silber ..... 405/229
6,915,618 B2 7/2005 Payne
7,103,984 B2 9/2006 Kastberg
7,374,369 B2 5/2008 Jakubowski
7,591,119 B2 * 9/2009 Ritz ..... 52/835
D607,711 S * 1/2010 Adams et al. ..... D8/354
7,677,522 B2 * 3/2010 Bakos ..... 248/500
7,694,476 B2 * 4/2010 Cook et al. ..... 52/296
7,779,588 B1 * 8/2010 Bruning ..... 52/297
7,805,895 B2 * 10/2010 Kristensen ..... 52/169.9
7,866,121 B2 * 1/2011 Polyzois et al. ..... 52/848
2001/0032427 A1 * 10/2001 Hoffman et al. ..... 52/299
2002/0017069 A1 * 2/2002 Hoffman et al. ..... 52/299
2003/0196394 A1 * 10/2003 Hoffman et al. ..... 52/299
2004/0093818 A1 * 5/2004 Simmons ..... 52/295
2004/0098935 A1 * 5/2004 Henderson ..... 52/296
2005/0183364 A1 8/2005 Cash (Continued)

*Primary Examiner* — William Gilbert
*Assistant Examiner* — James Ference
(74) *Attorney, Agent, or Firm* — Dennis W. Beech

(57) ABSTRACT

The present invention may be used for support of a structure attached to a foundation by a structure base flange. A weight distribution element may have a cross-section form that may be generally a trapezoid with an upper surface a lower surface, an outer side surface and an inner side surface. The outer side surface, and inner side surface may be inclined toward a centerline of the cross-section form transitioning from the bottom surface to the top surface. The weight distribution element may be formed of a material that may be moldable to a solid form having multiple bolt through-holes positioned for the weight distribution element to be disposed on bolts to be positioned adjacent a bolt support plate. The material may have a compression and strength composition sufficient to support a structure.

13 Claims, 2 Drawing Sheets

U.S. PATENT DOCUMENTS

2006/0010790 A1* 1/2006 Perry ..... 52/98
2008/0072511 A1 3/2008 Phuly
2008/0190058 A1 8/2008 Migliore
2008/0236075 A1 10/2008 Anderson
2008/0302038 A1* 12/2008 Wobben ..... 52/296
2009/0000227 A1 1/2009 Jakubowski
2009/0044482 A1 2/2009 Tooman
2009/0266016 A1* 10/2009 Kraft ..... 52/296
2009/0272053 A1* 11/2009 Dent ..... 52/296

* cited by examiner

PREFABRICATED WEIGHT DISTRIBUTION ELEMENT

BACKGROUND OF THE INVENTION

This invention relates to structures for support of vertically positioned structures, machines, towers, poles and the like that have a base flange for attachment to a foundation. The new weight distribution element may be prefabricated and placed in position with an assembled bolt structure at a ground site or excavation for pouring of a cementitious material to form a foundation with the weight distribution element having the bolts protruding therethrough for attachment of a tower base flange disposed on the weight distribution element.

Foundations for towers, poles and the like that have a base flange designed for attachment to bolts anchored in the foundation may be known. For large towers such as tubular structures that may be used to support wind driven apparatus, bolts may be positioned in a circular or ring structure anchored in a concrete base, for example, the structure disclosed in U.S. Pat. No. 5,586,417, Issued on Dec. 24, 1996. For this type of structure a circular trough is formed in the area of the cement foundation adjacent the bolts for placement of a tower base flange used to attach a tower to the foundation. It is also disclosed to cast-in-place an amount of high strength and compression grout material in the trough to level the tower base and distribute the load.

Various methods for applying grout in a trough may be known. There are also methods for sleeving the bolts anchored in the cement and for protecting the bolts from exposure to moisture to inhibit deterioration of the bolts. An example of an apparatus and method for protection of bolts and leveling of grout is disclosed in U.S. Patent Application No. 2009/0044482. Such an apparatus and method using a template requires many steps for forming the trough, manipulating the template and pouring the grout.

SUMMARY OF THE INVENTION

The present invention is directed to devices for support of a structure attached to a foundation by a structure base flange. A weight distribution element may have a cross-section form that may be generally a trapezoid with an upper surface, a lower surface, an outer side surface and an inner side surface. The outer side surface and inner side surface may be inclined toward a centerline of the cross-section form transitioning from the bottom surface to the top surface. The weight distribution element may be formed of a material that may be moldable to a solid form having multiple bolt through-holes positioned for the weight distribution element to be disposed on the bolts to be positioned adjacent a bolt support plate. The material may have a compression and strength composition sufficient to support a structure.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
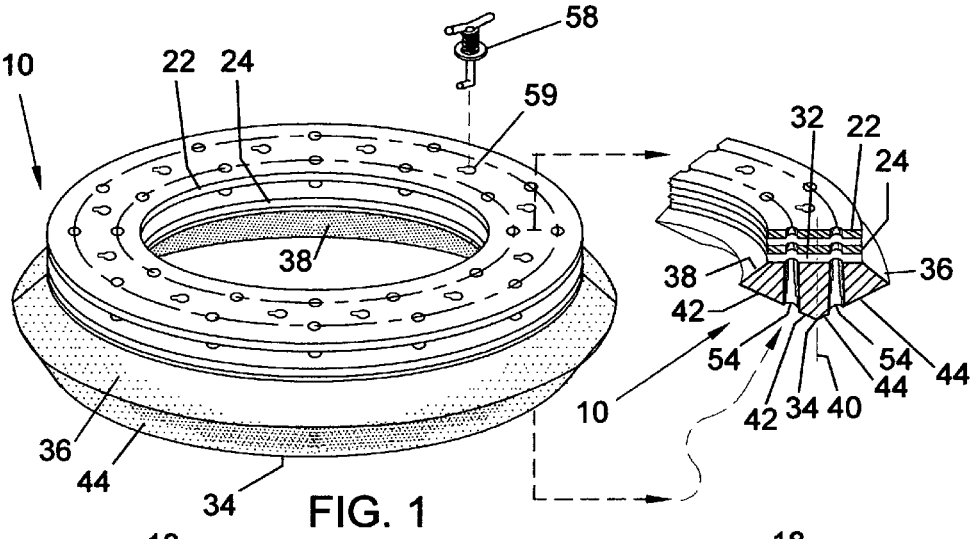
FIG. 1 illustrates a perspective view of a weight distribution element according to an embodiment of the invention.
Figure 2:
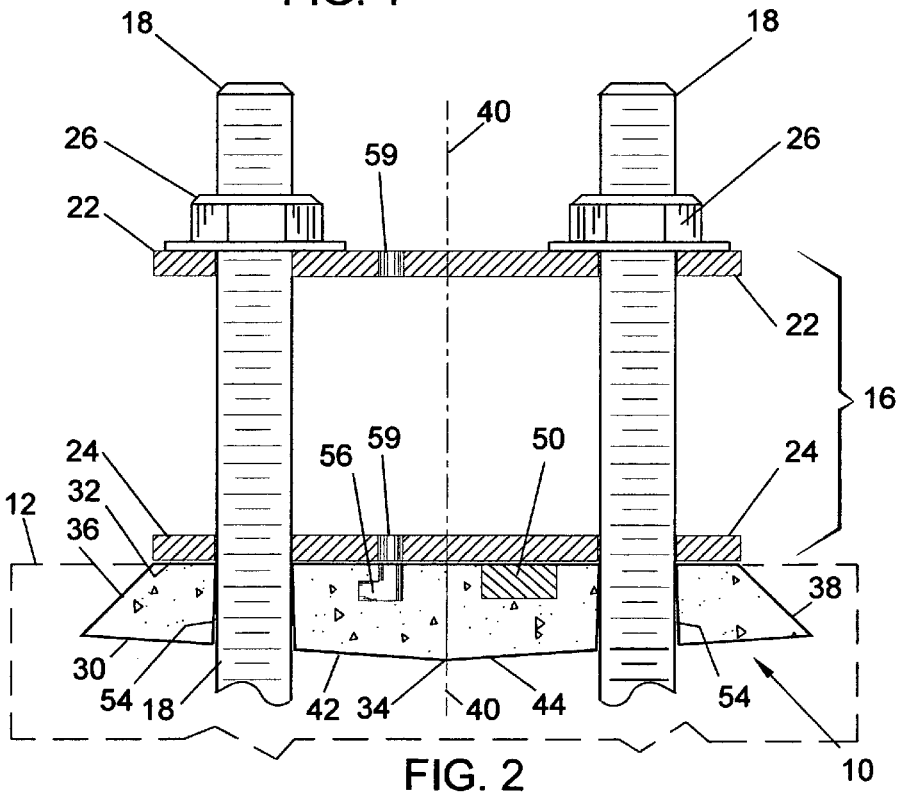
FIG. 2 illustrates a side cross-sectional elevation view of a weight distribution element and a template according to an embodiment of the invention.
Figure 3:
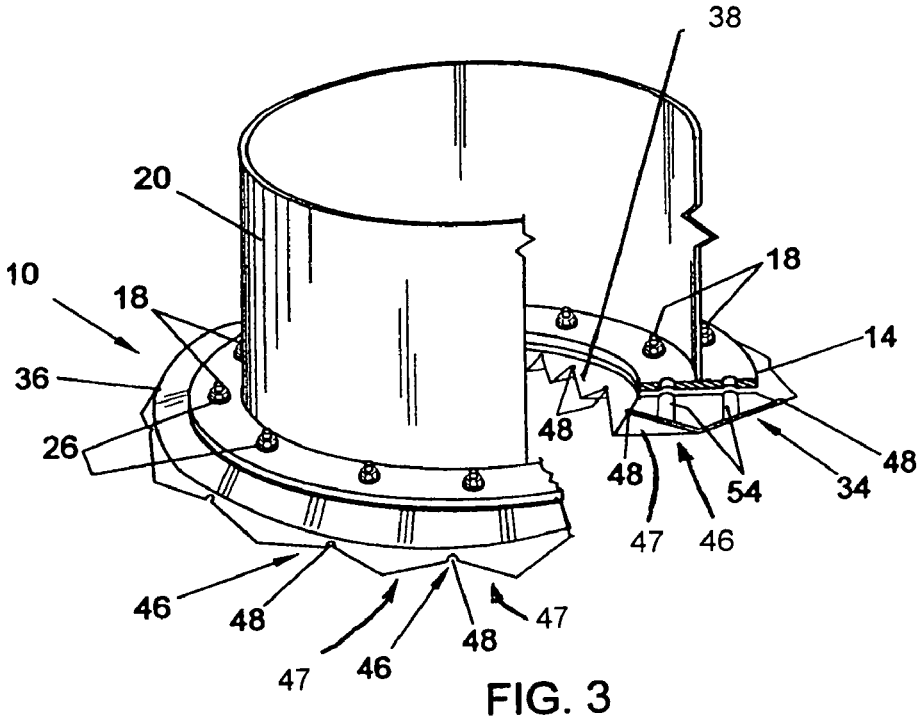
FIG. 3 illustrates a side perspective elevation view of a weight distribution element and base portion of a tower according to an embodiment of the invention.

Referring to FIGS. 1 through 3, a weight distribution element 10 for use with a foundation 12, tower base flange 14 and template 16 may be formed of material such as cementitious grout, epoxy grout, composite material, plastic and the like that can be formed, molded or shaped for a defined shape and may then be positioned below a template 16 for positioning with the bolts 18 in a foundation 12 cementitious structure. The composition of the material of the weight distribution element 10 may be a high compression and strength form depending on the forces to be experienced from a structure or tower 20 installation. While a cylindrical tower 20 with a base flange may be used to describe the invention, other structures such as buildings, machinery, rectangular or other shape towers, poles and the like may be installed on a weight distribution element having the appropriate shape for the structure.

The weight distribution element 10 may have a generally annular ring shape to match the ring shape pattern of bolts 18 to be anchored in a foundation 12 for a typical wind turbine generator tower 20. The cross-section form 30 of the weight distribution element 10 may be a trapezoid with upper and lower surfaces 32, 34 generally parallel and side surfaces 36, 38 inclined toward the centerline 40 proceeding from the bottom to the top surfaces 32, 34. Inwardly inclined side surfaces 36, 38 may aid in retaining the weight distribution element 10 in the foundation 12 and allow increased support by increasing the square inch surface contact thereby decreasing psi pressure as compared to existing structures that use vertical or outwardly inclined side walls for grout troughs. The incline of the top surfaces 36, 38 may be 1:1 or 45 degrees.

The lower surface 34 may also be flat or an irregularly shaped surface for improving contact surface strength with the concrete of a foundation 12. The lower surface 34 may also have an inclined subtending structure formed of two surfaces 42, 44, as best viewed in FIGS. 1 and 2. This may aid water and air that may be located above the concrete and below the lower surface 34 during the pouring and curing of the concrete to migrate upwardly and outwardly from below the weight distribution element 10 to allow improved surface contact between the weight distribution element 10 and the foundation 12. The lower surface 34 may alternatively have radially extending and upwardly inclined grooves 46 with sidewalls 47 from a centerline 40 to an outer side surface 36 and an inner side surface 38 to aid in water and air removal, as best viewed in FIG. 3. The grooves 46 may have an upper open inverted conduit 48 to aid in the air and fluid migration.

In use, the weight distribution element 10 may be temporarily attached to a bottom plate 24 of a template 16 and the combination positioned on the bolts 18. The weight distribution element 10 may be positioned on the template bottom plate 24 with a sticky/adhesive fit, magnets 50, or mechanical fasteners such as twist latch 58 and sockets 56, and the bottom plate 24 may be positioned on the bolts 18 adjacent the weight distribution element 10. A top plate 22 may be positioned on the bolts 18 above and spaced apart from the bottom plate 24. Upper nuts 26 may be installed on the bolts 18 above the top plate 22 to form the template 16 as generally understood in the art. In some installations a template may not be necessary and the element may be supported by nuts on bolts. The assembly may then be positioned at a ground site or excavation for pouring of a cementitious material to form a foundation 12. Once the concrete has sufficiently cured, the template 16 may be removed leaving the weight distribution element 10 in place in the concrete. The weight distribution element 10 may be positioned prior to pouring of the concrete such that the upper surface 32 is in the plane of the foundation 12 surface and is leveled for support of a tower support flange 14 that may be placed directly on the upper surface 32. The upper surface 32 may also be positioned higher or lower than the foundation 12 surface.

While the use of a weight distribution element 10 has been disclosed with the use of a template 16 having a top plate 22 and bottom plate 24 as understood for templates in the art, a single plate 24 may be used since a trough is not required to be formed in the foundation 12 concrete. For such use, the upper nuts 26 may be installed on the bolts 18 to abut the top surface of the single plate 24.

A sticky or adhesive upper surface 32, magnets 50 or mechanical fasteners 58 may be used to maintain contact with a plate 24 of a template 16 when positioning the bolts 18 in a ground installation and during the pouring of concrete. Magnets 50 or sockets 56 may also be embedded in the weight distribution element 10 adjacent the upper surface 32 to maintain contact. In the instance of the use of sockets 56 and mechanical fasteners 58, the bottom plate 24 may have holes 59 for the shaft of a fastener 58 to pass through to engage a socket 56.

The weight distribution element 10 may have multiple tapered bolt apertures 54 formed therein positioned for the bolts 18 to pass therethrough to be positioned therein or to pass therethrough.

Figure 4:
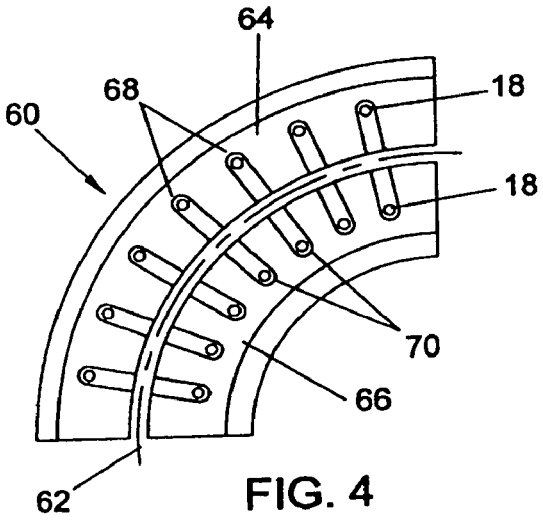
FIG. 4 illustrates a top view of a weight distribution element according to an embodiment of the invention.
Figure 5:
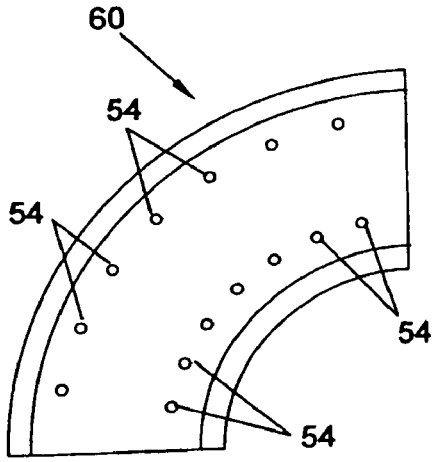
FIG. 5 illustrates a top view of a weight distribution element according to an embodiment of the invention.

Referring to FIGS. 4 and 5, the weight distribution element 10 may be sectioned into two or more annular partially circular segments 60 that may also be partitioned or cut along a circular center line 62 to form an outer element 64 and inner element 66. An outer bolt slot 68 may be formed in outer element 64 and an inner bolt slot 70 may be formed in inner element 66. Each outer bolt slot 68 and inner bolt slot 70 may be formed opposed and positioned to allow slidable engagement with a pair of bolts 18 to position an outer element 64 and an inner element 66 to abut one another. If the weight distribution element 10 is not cut along the circular center line 62, the segments 60 may have appropriately positioned bolt apertures 54.

Referring again to FIG. 3, other irregular lower surfaces 34 may also be used, for example, a zig-zag form, curved line surfaces, surfaces without radial grooves, as well as others. A weight distribution element 10 may also be used to fill an existing foundation 12 trough.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for support of a structure attached to a foundation by a structure base flange comprising:

a weight distribution element that has a cross-section form comprising an upper surface, a first lower surface, a second lower surface, an outer side surface and an inner side surface, wherein said outer side surface and said inner side surface are inclined toward a centerline of said cross-section form, wherein said outer side surface transitions from said first lower surface to said upper surface, and said inner side surface transitions from said second lower surface to said upper surface;

said first lower surface being inclined downwardly from said outer side surface toward said centerline and said second lower surface being inclined downwardly from said inner side surface toward said centerline;

said weight distribution element formed of a material that is moldable to a solid form having a plurality of bolt apertures therein traversing from said upper surface to said first and second lower surfaces positioned for said weight distribution element to be disposed on a plurality of bolts to be positioned adjacent a bolt support plate; and said material has a compression and strength composition sufficient to support a structure.

2. The device as in claim 1 wherein said material is formable and shapeable.

3. The device as in claim 1 wherein said first and second lower surfaces are irregular surfaces.

4. The device as in claim 1 wherein there are a plurality of outwardly extending grooves in said first lower surface extending in a direction from said centerline to said outer side surface and in said second lower surface extending in a direction from said centerline to said inner side surface.

5. The device as in claim 4 wherein said outwardly extending grooves are inclined upwardly from said centerline.

6. The device as in claim 4 wherein said outwardly extending grooves have an upper inverted conduit at an apex.

7. The device as in claim 1 wherein a plurality of magnets are disposed in said weight distribution element adjacent to said upper surface.

8. The device as in claim 1 wherein a plurality of twist latch sockets are disposed in said weight distribution element adjacent to said upper surface for engagement with a plurality of twist latches.

9. The device as in claim 1 wherein said weight distribution element is comprised of a plurality of partially circular segments.

10. The device as in claim 9 wherein each of said partially circular segments is partitioned into an outer element and an inner element along a second centerline.

11. The device as in claim 10 wherein said bolt apertures are an outer slot and an inner slot forming said bolt aperture when each of said outer elements and said inner elements are positioned to abut.

12. The device as in claim 1 wherein said weight distribution element is a generally annular ring shape.

13. The device as in claim 1 wherein said bolt apertures are tapered.

* * * * *